US006186745B1

(12) United States Patent
Johnson

(10) Patent No.: US 6,186,745 B1
(45) Date of Patent: Feb. 13, 2001

(54) GAS PRESSURIZED LIQUID PUMP WITH INTERMEDIATE CHAMBER

(75) Inventor: Kenneth Alan Johnson, Stockton, CA (US)

(73) Assignee: Chemand Corporation, San Jose, CA (US)

( * ) Notice: Under 35 U.S.C. 154(b), the term of this patent shall be extended for 0 days.

(21) Appl. No.: 09/301,518

(22) Filed: Apr. 28, 1999

(51) Int. Cl.[7] ..... F04F 1/06
(52) U.S. Cl. ..... 417/54; 417/121; 417/131
(58) Field of Search ..... 417/53, 54, 121, 417/130, 131, 132, 138; 222/137

(56) References Cited

U.S. PATENT DOCUMENTS

| | | | | |
|---|---|---|---|---|
| 1,979,407 | | 11/1934 | Pike | 137/79 |
| 2,158,381 | | 5/1939 | Raymond | 73/224 |
| 2,246,594 | | 6/1941 | Kinsella | 103/11 |
| 2,520,175 | | 8/1950 | Socke | 222/396 |
| 2,545,303 | | 3/1951 | Petrucci | 222/67 |
| 2,703,607 | | 3/1955 | Simmonds | 158/46 |
| 4,132,242 | | 1/1979 | Carroll, Jr. | 137/263 |
| 4,136,708 | * | 1/1979 | Cosentino et al. | 137/99 |
| 4,507,056 | * | 3/1985 | Allen | 417/54 |
| 4,544,084 | | 10/1985 | Cleland | 222/56 |
| 4,630,753 | | 12/1986 | Anscherlik | 222/17 |
| 4,676,404 | | 6/1987 | Yamazaki et al. | 222/56 |
| 5,294,023 | | 3/1994 | Ioannides et al. | 222/61 |
| 5,405,443 | | 4/1995 | Akimoto et al. | 118/668 |
| 5,511,954 | * | 4/1996 | Han | 417/121 |
| 5,556,002 | | 9/1996 | Green | 222/21 |

* cited by examiner

*Primary Examiner*—Charles G. Freay
(74) *Attorney, Agent, or Firm*—Robert O. Guillot; Oppenheimer Wolff & Donnelly LLP

(57) ABSTRACT

The multi-chamber liquid pump of the present invention includes an input chamber, an intermediate chamber and a liquid output chamber. Pressurized gas provides the motive force for outputting liquid from the pump, such that liquid is output at a constant flow rate during pump operation. Liquid flows into the input chamber, through one or more valves into the intermediate chamber, and through one or more subsequent valves to the output chamber while liquid is constantly output from the output chamber. The system controller provides control signals to the valves to facilitate the pump's continual operation.

17 Claims, 3 Drawing Sheets

GAS PRESSURIZED LIQUID PUMP WITH INTERMEDIATE CHAMBER

BACKGROUND OF THE INVENTION

1. Field of the Invention

The present invention relates generally to devices for pumping liquid, and more particularly to a liquid pumping device that is activated by pressurized gas, and which contains an input chamber, an intermediate chamber and an output chamber.

2. Description of the Prior Art

In nearly every fluid transfer application it is necessary to provide a pump to provide the motive force to move the liquid through a liquid supply line. With the exception of gravitational systems and siphon systems, the utilization of liquid pumps is a necessity and many types of pumps have been developed throughout history. Many of the pumps are powered by rotating or reciprocating motorized devices which tend to create a vibration or pulsation in the pumped liquid and the systems that utilize such pumps. For many applications the vibration and pressure pulsation of such pumps is insignificant and such pumps provide adequate performance.

However, many liquid transfer applications involve liquids having a delicate chemical make-up and chemical processes that are adversely affected by the pulsation and vibration of pumped liquid. For such applications it is necessary to utilize a pump that does not create pulsation and vibration of the pumped fluid. Additionally, many precise chemical processes require strict control of the flow rate of the pumped liquid, and prior art pumps that induce pulsation and vibration within the pumped fluids have difficulty meeting such flow rate constraints. Semiconductor fabrication processes are one such application in which ever stricter constraints on liquid pumping parameters continue to be developed. In many particular applications within the semiconductor fabrication industry pulsation and vibration of pumped chemicals adversely affects the delicate chemical balance of processing liquids as well as the chemical reactions of the processing liquids with the semiconductor substrates in the various fabrication steps.

A need therefore exists for pumps that pump liquids without subjecting the liquids to pulsation and vibration, while providing tight control of the flow rates of the pumped liquids. The present invention, in its various embodiments disclosed herein, provides a pump system that utilizes pressurized gas to provide the motive force to continuously pump liquids through liquid flow lines. The pulsation and vibration created by the prior art pumping systems is eliminated and a strict control of pumped liquid flow rates is obtained.

SUMMARY OF THE INVENTION

The multi-chamber liquid pump of the present invention includes an input chamber, an intermediate chamber and a liquid output chamber. Pressurized gas provides the motive force for outputting liquid from the pump, such that liquid is output at a constant flow rate during pump operation. Liquid flows into the input chamber, through one or more valves into the intermediate chamber, and through one or more subsequent valves to the output chamber while liquid is constantly output from the output chamber. The system controller provides control signals to the valves to facilitate the pump's continual operation.

It is an advantage of the present invention that a liquid pump is provided which pumps liquid without vibration and pulsation.

It is another advantage of the present invention that a liquid pump is provided which pumps liquid in a smooth, constant, non-fluctuating flow.

It is a further advantage of the present invention that a liquid pump is provided that utilizes pressurized gas to provide a pumping force for the liquid.

It is yet another advantage of the present invention that a liquid pump is provided that is gas powered and provides a constant controlled liquid flow rate.

It is yet a further advantage of the present invention that a liquid pump is provided having an input chamber, an intermediate chamber and an output chamber, such that liquid flowing from the output chamber can be replaced by liquid from the input chamber through the use of the intermediate chamber.

These and other features and advantages of the present invention will become apparent to those skilled in the art upon review of the following detailed description which makes reference to the several figures of the drawing.

IN THE DRAWINGS

DETAILED DESCRIPTION OF THE PREFERRED EMBODIMENTS

Figure 2:
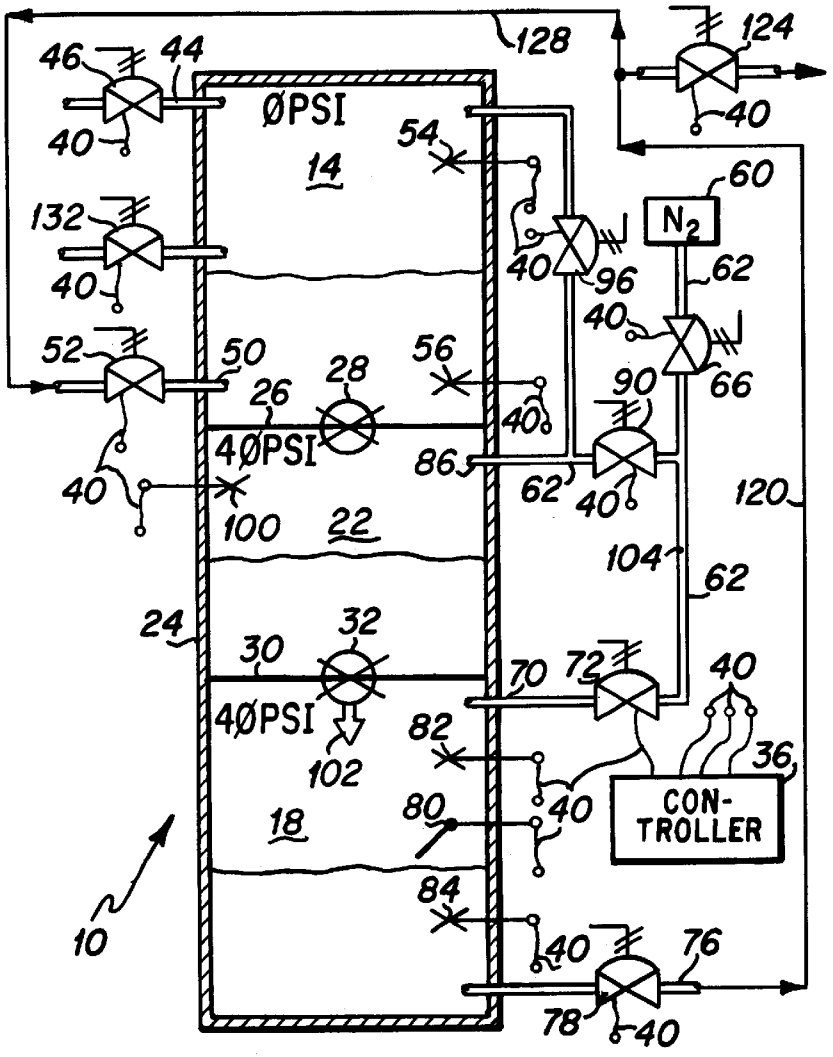
FIG. 2 is a diagrammatic representation of the pump depicted in FIG. 1 in a second pumping stage.
Figure 1:
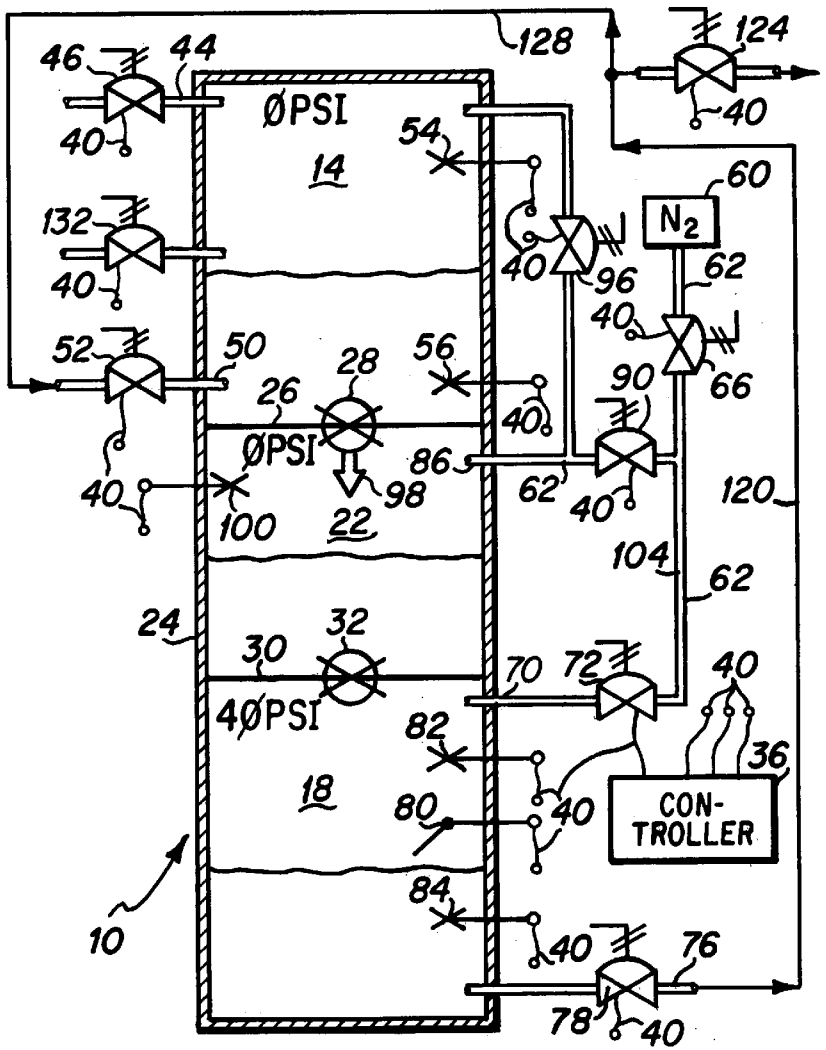
FIG. 1 is a diagrammatic depiction of a pump of the present invention in a first stage.

A first embodiment of the pump 10 of the present invention is diagrammatically depicted in FIGS. 1 and 2, wherein FIG. 1 depicts the pump in a first stage and FIG. 2 depicts the pump in a second stage. As depicted in FIGS. 1 and 2, the pump 10 has three separate chambers, an input chamber 14, an output chamber 18 and an intermediate chamber 22. Each chamber 14, 18 and 22 is defined by chamber walls 24. In the preferred embodiment, a first interior chamber wall 26 having a flow control valve 28 disposed therewithin, separates the input chamber 14 from the intermediate chamber 22. In a like manner, a second interior chamber wall 30 having a flow control valve 32 disposed therewithin, separates the intermediate chamber 22 and the output chamber 18. The pump 10 further includes a computerized pump controller 36 that is electronically engaged to various gas flow control valves and liquid level detectors and float sensors, as are described in detail herebelow to automatically control and regulate the flow of liquid through the pump. In the embodiment 10 depicted in FIGS. 1 and 2, electrical signal lines 40 are shown at the controller 36 and at the various valves, detectors and sensors for providing control signals to and from the controller 36; for ease of depiction, the electrical control lines 40 are not shown to be fully connected in FIGS. 1 and 2, it being understood that individual electrical control lines are engaged between the controller and the various controlled valves, detectors and sensors.

A gas vent 44 is engaged to the input chamber 14 to generally maintain the input chamber 14 at atmospheric pressure (0 psi) throughout the pump operation process. A controlled gas valve 46, that is nominally open, may be engaged to the vent, when control of the input chamber venting is desired, as may be the case where volatile or dangerous chemicals are processed by the pump. A liquid inlet line 50 having a controlled liquid valve 52 is engaged to the input chamber 14, to input liquid into the input chamber 14. While not required, a liquid level HI detector 54 and a liquid level LO detector 56 may be installed in the input chamber to provide alarm signals to the controller in the event that the liquid level within the input chamber 14 is determined to be either too high or too low for proper pump operation.

A source of pressurized gas 60, preferably but not necessarily nitrogen, is fed through gas lines 62, that are controlled by gas control valves described herebelow to provide pressurized gas to the output chamber 18 and intermediate chamber 22. A controlled gas input valve 66 serves to meter the gas into the pump 10. The output chamber 18 includes a pressurized gas input line 70 that is by a controlled gas valve 72. In the preferred embodiment, the gas pressure in the output chamber 18 is maintained at generally a constant positive pressure of approximately 2–40 psi depending upon system requirements, and the gas valve 72, together with the controller 36 seek to maintain that pressure regardless of the liquid level within the output chamber 18. A liquid output line 76, that is regulated by a controlled liquid output valve 78 is engaged to the output chamber 18 to outlet liquid therefrom. A significant feature of the pump 10 is that liquid is output through the liquid output line 76 at a smooth, constant, non-fluctuating flow rate that is controlled by the controller 36 through the operation of the liquid outlet valve 78 and the gas pressure in the output chamber 18. In a preferred embodiment of the pump 10 the liquid is output at a constant flow rate such as five gallons per minute at 40 psi constant pressure.

A liquid level sensor, such as a float valve 80, is disposed within the output chamber 18 and engaged to the controller 36 to provide information regarding the level of liquid within the output chamber 18. Additionally, although not necessary, a liquid level HI sensor 82 and a liquid level LO sensor 84 may also be installed in the output chamber 18 to provide signals to the controller should the liquid level within the output chamber become unacceptably HI or unacceptably LO.

It will be appreciated that as liquid in the output chamber 18 is output through the output line 76, that the liquid level within the output chamber 18 will fall, and will require replenishment. To achieve this, liquid is added to the output chamber 18 from the intermediate chamber 22 through the valve 32, as is next discussed.

Generally, the intermediate chamber 22 serves to receive liquid from the input chamber 14 during a first phase of pump operation, and dispense liquid from the intermediate chamber 22 into the output chamber 18 during a second phase of pump operation. Unlike the input chamber 14 and output chamber 18, the gas pressure within the intermediate chamber 22 is varied utilizing the gas lines and controlled gas valves discussed herebelow, and the variation in the gas pressure of the intermediate chamber 22 is utilized to fill and empty it. Specifically, as depicted in FIG. 1, a gas line 86 feeds pressurized gas through controlled gas valve 90 into the intermediate chamber 22. Gas in intermediate chamber 22 is exhausted through gas line 86 to gas vent line 94 under the regulation of controlled gas valve 96 and into the input chamber 14. The gas pressure in the intermediate chamber 22 is reduced to 0 psi through the closure of gas valve 90 and the opening of valve 96 to open a gas line passage between the intermediate chamber 22 and the input chamber 14 at 0 psi, whereby the gas pressure in the intermediate chamber 22 will also drop to 0 psi. At that time, the valve 28 between the input chamber 14 and the intermediate chamber 22 will open due to equal gas pressure on both sides of it, and the weight of liquid in the input chamber upon it. Liquid within the input chamber 14 will then flow 98 into the intermediate chamber 22. Displaced gas in the intermediate chamber 22 will flow through the gas lines 86 and 94 and open valve 96 into the input chamber 14. A liquid level HI sensor 100 may be included within the intermediate chamber 22 to provide control signals to the controller that the liquid level within the intermediate chamber 22 has reached a HI level, at which point the valve 96 is closed and gas valve 90 is opened to provide some gas pressure within the intermediate chamber 22 to close the liquid inlet valve 28 because the intermediate chamber 22 has become full. Thereafter, when the liquid level in the output chamber 18 falls below the level of the float valve 80, it is necessary to replenish the liquid level within the output chamber 18. To accomplish this, as depicted in FIG. 2, gas valve 90 opened to increase the gas pressure within the intermediate chamber 22 and equalize it with the gas pressure of the output chamber 18 at the elevated pressure of the output chamber 18. When the gas pressure in the intermediate chamber 22 rises the liquid control valve 28 closes. When the gas pressure in chambers 22 and 18 is equalized, the liquid control valve 32 opens and liquid from the intermediate chamber 22 flows 102 into the output chamber 18. Displaced gas from the output chamber 18 flows through the gas lines 70, 104 and 86 and open gas valves 72 and 90 into the intermediate chamber 22. It is to be understood that the liquid output from the output chamber 18 has remained at a generally constant flow rate during the filling process of the output chamber 18, as the output chamber pressure has been maintained at a generally constant value. When the liquid level within the output chamber 18 rises above the float valve 80, the controller closes gas valve 90 and opens valve 96 to reduce the gas pressure within the intermediate chamber 22, whereupon the liquid control valve 32 closes, thus halting the flow of liquid from the intermediate chamber 22 into the output chamber 18. When the gas pressure in the intermediate chamber 22 reaches 0 psi, the liquid control valve 28 between the input chamber 14 and the intermediate chamber 22 will open to refill the intermediate chamber 22.

It is therefore to be understood that the pump 10 functions in a two step manner to replenish liquid in the pressurized output chamber 18 while continuously maintaining the pressure within the output chamber 18 at a generally constant value, such that the output flow of liquid from the output chamber 18 maintains a smooth, constant, non-fluctuating flow rate. It is to be further understood that the ongoing operation of the pump 10 is primarily controlled by the liquid level sensor 80 in the output chamber. That is, when the sensor 80 provides signals to the controller 36 that further liquid is required in the output chamber 18, signals are sent by the controller to the appropriate gas valves to pressurize the intermediate chamber to the pressure level of the output chamber, whereupon the valve 32 opens to allow liquid in the intermediate chamber to flow into the output chamber. When the sensor 80 sends a signal to the controller that the output chamber is full, the controller sends signals to depressurize the intermediate chamber, which closes the valve 32. When the pressure level of the intermediate chamber 22 reaches the pressure level of the input chamber, the valve 28 opens and liquid is input into the intermediate chamber from the input chamber. When the liquid level in the output chamber drops to a level that again activates the liquid level sensor 80, the two step process commences once again. Thus, signals from the liquid level sensor 80 of the output chamber 18 provide the control signals for the operation of the pump 10.

Many applications for the gas pressurized pump of the present invention will be envisioned by those skilled in the art. A first such application is as a recirculation and fluid delivery pump. In such an installation, the output line 76 is connected through output line 120 to a controlled fluid output delivery valve 124. When valve 124 is opened fluid is delivered from the output chamber through output line 120 and valve 124 to an outside application. Replacement fluid is thereupon fed into the input chamber 14 through fluid input line 50 utilizing controlled valve 52. The low liquid level sensor 56 in the input chamber 14 provides the necessary sensor signal to trigger liquid input through input line 50. A recirculation line 128 is joined to the liquid output line 120 to return liquid to the input chamber 14 under the control of control valve 132. That is, when the liquid output valve 124 is closed, the liquid recirculation valve 132 is open and the pump continues to operate as a recirculation pump, wherein liquid is constantly outlet through the output chamber 18 and recirculated through recirculation line 128 into the input chamber 14. As is known to those skilled in the art, liquid recirculation is particularly important for deionized water and many chemical solutions, and the gas pressurized liquid pump of the present invention accomplishes both recirculation and pumped liquid output without the vibration and liquid pulsation that accompanies mechanical pumping devices.

Figure 3:
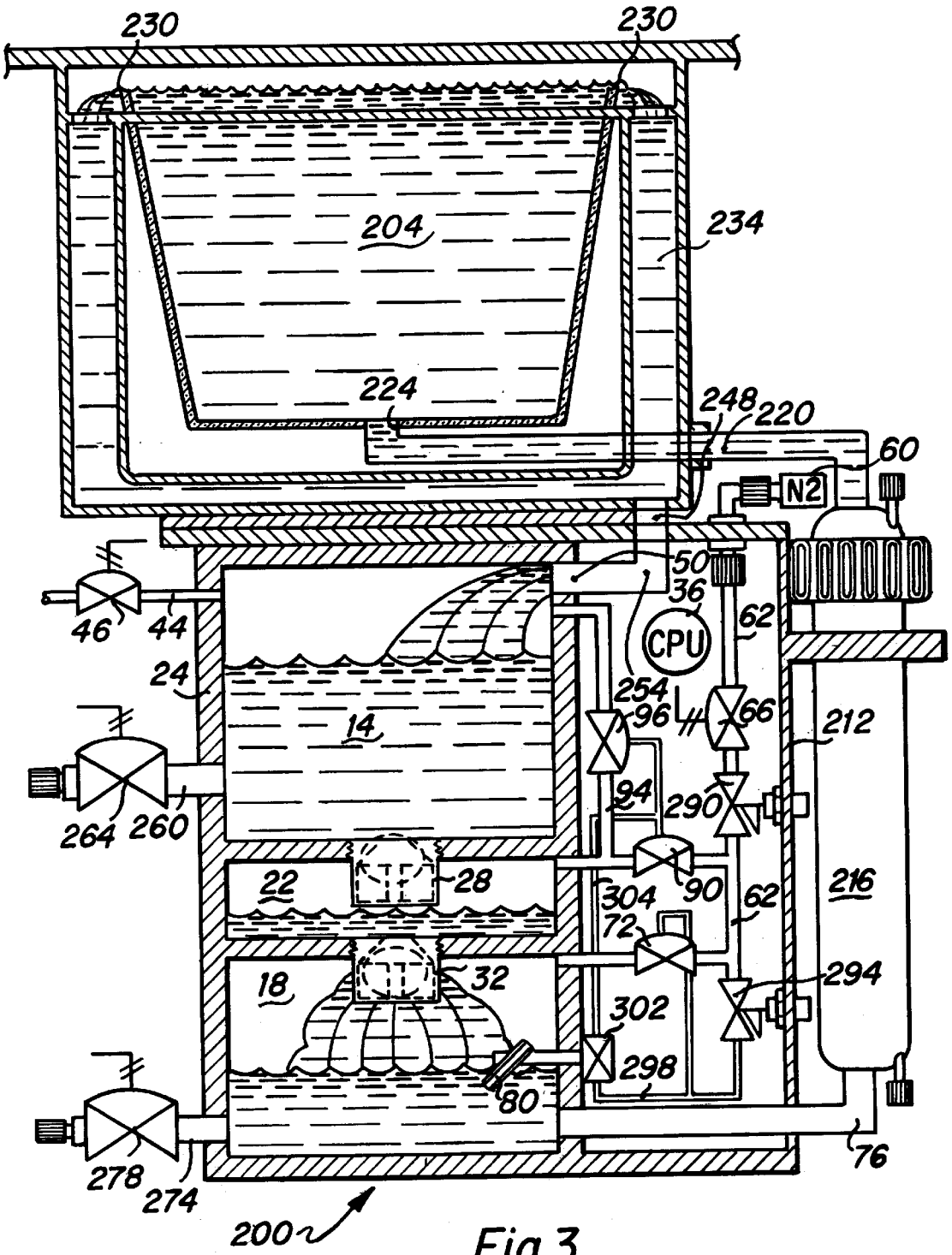
FIG. 3 is a diagrammatic depiction of another embodiment of the pump of the present invention installed with a chemical processing container.

FIG. 3 depicts an installation 200 of a second pump embodiment 202 of the present invention with a constant flow rate liquid bath 204 that is suitable for many chemical processing steps that are typically conducted within the semiconductor fabrication industry. As depicted in FIG. 3, common features and components of the pump 10, as described hereabove with reference to FIGS. 1 and 2 are provided with identical numbers for ease of comprehension. The pump 202 includes chamber walls 24 that define the input chamber 14, the output chamber 18 and the intermediate chamber 22. Further housing walls 212 enclose the controlled gas valves and gas lines identified hereabove.

The liquid output line 76 is connected to a filter 216 and the output line 220 from the filter 216 is fed to a bath liquid inlet 224 located in the bottom of the bath 204. Liquid fills the bath 204 and spills outwardly over the lip 230 of the bath 204 and into a bath holding basin 234. A drain 248 is located in the base of the basin 234, and a drain line 254 connects the drain 248 with the input line 256 of the pump 202. It is therefore to be understood that the pump installation 200 basically constitutes a liquid recycling installation. That is, liquid from the output line is circulated through the bath 204 and returns through the input line 256, and the continual operation of the pump 202 is maintained where the liquid flow rate into the input chamber is the same as the liquid flow rate from the output chamber.

As depicted in FIG. 3, the input chamber 14 includes a gas vent 44 that is controlled by a normally open controlled gas valve 46. A liquid inlet line 260 having a controlled liquid valve 264 is utilized to input liquid into the installation 200. A liquid drain line 274 having a controlled liquid valve 278 is utilized to drain liquid from the installation 200.

Regarding the controlled gas valve configuration, nitrogen gas 60 is inlet through gas lines 62 through controlled gas valve 66. A manually operated gas control valve 290 is also disposed in the gas line 62 to provide a manual shutoff for the nitrogen gas. A second manual gas control valve 294 meters the gas to gas valve control lines 298 which provide pressurized gas to the valve control system of pump 202. Control gas in control lines 298 is provided to a controlled gas valve 302 that is controlled by the output chamber float valve sensor 80 and to the output chamber controlled gas valve 72. A portion 304 of the control lines 298 feed control gas from the control valve 302 to the intermediate chamber controlled gas valve 90 and to the intermediate chamber controlled gas vent valve 96. As depicted in FIG. 3, the controlled gas valve 72 is nominally pressurized to be in the open position, such that the gas pressure in the output chamber remains constant to provide the motive force to output liquid therefrom. The gas valve 302 controls the flow of valve control gas to the portion 304 of the gas valve control lines 298, such that the gas pressure in the portion 304 of the control lines 298 is controlled by the sensor 80. That is, when valve 302 is open, such that control line portion 304 holds pressurized gas, controlled gas valve 90 is nominally open whereas controlled gas valve 96 is nominally closed. When the valve 302, as manipulated by the float valve 80, is closed, the valve 302 vents the gas pressure in the line 304, and controlled gas valve 90 closes and controlled gas valve 96 opens. It is therefore to be understood, that the two step operation of the pump 202, as depicted in FIG. 3, is controlled by the float valve 80, which controls only two gas valves, the gas input valve 90 to the intermediate chamber 22 and the intermediate chamber gas vent valve 96.

The pump 202, as depicted in the installation 200, functions similarly to the pump 10 depicted in FIGS. 1 and 2 and described hereabove. Basically, the gas pressure inlet valve 72 to the output chamber 18 is nominally on, such that output chamber 18 is at all times pressurized, whereby liquid in the output chamber 18 is at all times being output at a constant controllable rate through the output line 76, through the filter 216 and into the inlet 224 of the liquid bath 204. Simultaneously, liquid in the bath 204 is at all times spilling over the lip 230 of the bath 204 and into the bath holding basin 234, and subsequently passing through the drain 248 and into the inlet line 50 of the input chamber 14, such that liquid is at all times flowing into the input chamber 14. In this manner, the pump 202 maintains a constant smooth flow of liquid through the bath 204. As liquid is output from the output chamber, the liquid level of the output chamber 18 drops. When the liquid level in the output chamber drops sufficiently to activate the float valve 80, the valve 302 opens to deliver pressurized gas in the valve control line 304, whereupon the line 304 is pressurized, causing control gas valve 90 to open and control gas valve 96 to close. In this valve configuration, pressurized gas is fed into the intermediate chamber 22 to equalize its gas pressure with that of the output chamber 18, whereupon liquid flows through valve 32 and into the output chamber 18 to fill it. When the float valve 80 in the output chamber rises to the full level indication, the valve 302 closes and vents the gas pressure in the line 304, whereupon the gas control valve 90 closes and the gas control valve 96 opens. In this valve configuration, the pressurized gas in the intermediate chamber 22 vents into the input chamber 14, and when the pressure in the intermediate chamber and input chamber are equal, the liquid valve 28 opens to provide further liquid to the intermediate chamber 22. Meanwhile, liquid is being output from the output chamber, and when the liquid level in the output chamber drops sufficiently to activate the sensor 80 again, the valve 302 opens to provide pressurized gas to the control line 304, whereupon the input valve 90 opens and the vent valve 96 closes, thus initiating the two step pump cycle again. It is therefore to be understood that the ongoing operation of the pump 202, as depicted in FIG. 3, is dependent primarily upon the provision of pressurized gas 60 to the gas valving system, and the existence of liquid within the various chambers 14, 22 and 18, and particularly chamber 18, such that the action of the float valve 80, as determined by the level of liquid in the output chamber 18, controls the flow of liquid throughout the pump. That is, the ongoing operation of the pump 202 is not electrically controlled, but rather it is controlled by the provision of pressurized gas together with a sufficient quantity of liquid.

Figure 4:
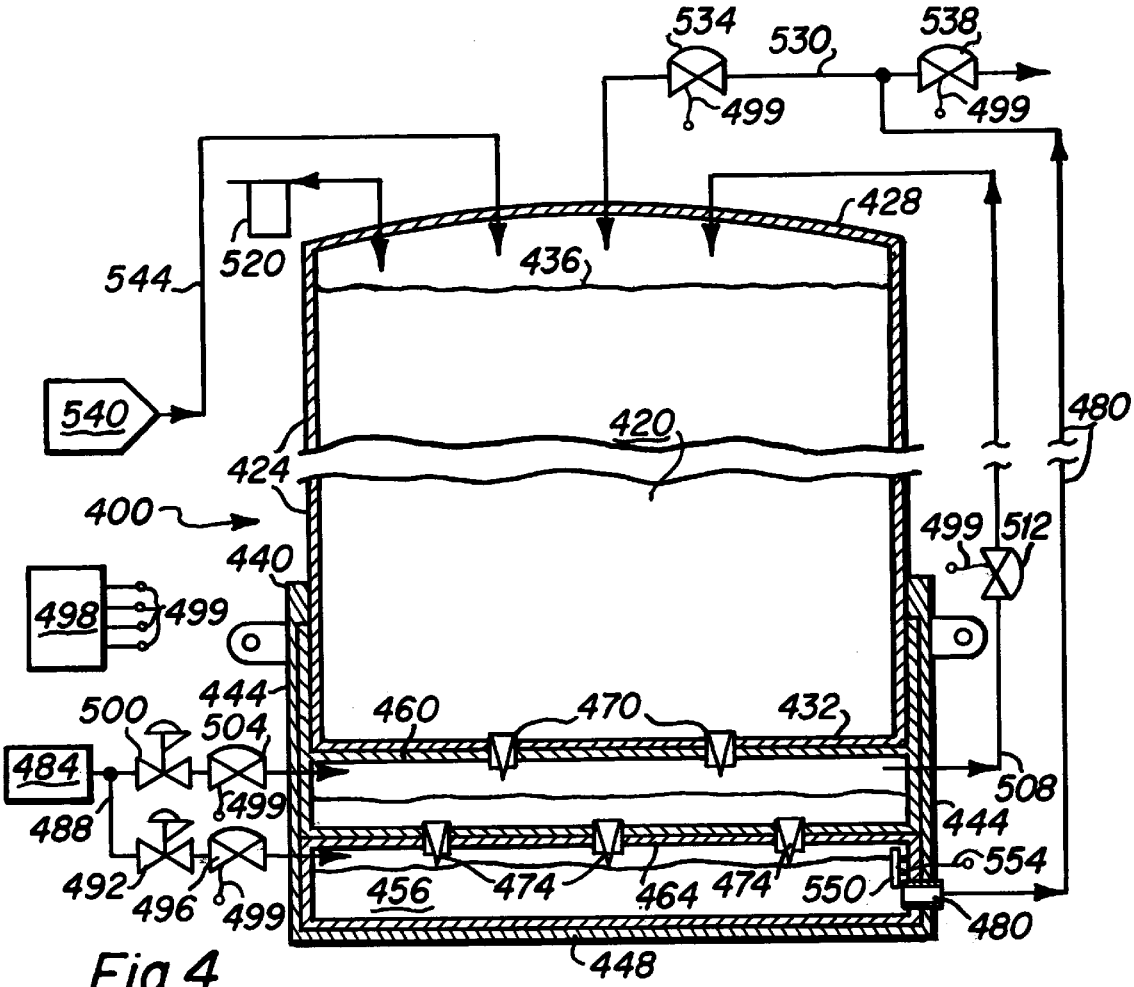
FIG. 4 is a diagrammatic depiction of a further embodiment of the present invention installed within a day tank.

A further embodiment 400 of the present invention is depicted in FIG. 4 wherein a gas pressurized liquid pump 400 is installed with a large liquid holding tank 420, such as a day tank, that is commonly used in the semiconductor processing industry to hold a day or more supply of liquid such as deionized water. Such tanks may be 10 to 15 feet tall and hold thousands of gallons of liquid. As depicted in FIG. 4, the day tank 420 has cylindrical sidewalls 424, a domed top 428 and a flat, round base 432, such that a quantity of liquid to level 436 is held therein. A tank holding pump structure 440 includes cylindrical sidewalls 444 that are joined to a circular base 448. The pump structure 440 is divided into an intermediate chamber 452 and an output chamber 456 by two interior walls 460 and 464. By way of comparison with the pump embodiments 10 and 202 described hereabove, it is to be understood that the day tank 420 functions as the input chamber 14 of the pump, and two liquid flow control float valves 470 disposed in the first interior wall 460 permit the flow of liquid from the tank 420 into the second interior intermediate chamber 452, and three liquid control float valves 474 disposed in the intermediate wall 464 facilitate the flow of liquid from the intermediate chamber 452 into the output chamber 456. A liquid outlet line 480 is utilized to outlet liquid from the output chamber 456 to chemical processing tools which require the liquid.

Pressurized nitrogen gas is fed from a source 484, through gas lines 488 to a manual gas regulator valve 492 and a controlled gas valve 496 into the output chamber 456. The controlled gas valve 496 and other controlled gas and liquid valves described herein are controlled electrically utilizing a computerized system controller 498 that is electrically engaged to the various controlled components utilizing control lines 499. Thus, as with the gas pressurized pump embodiments 10 and 202 discussed hereabove, pressurized gas through controlled valve 496 is utilized to maintain a constant liquid output pressure within the output chamber 456 to maintain a controlled, continuous liquid output flow in outlet line 480. Pressurized nitrogen gas is also fed through lines 488 through a manual gas regulator valve 500 and a controlled gas pressure valve 504 into the intermediate chamber 452. As with previous embodiments 10 and 202, pressurized gas through controlled valve 504 is utilized to change the pressure within the intermediate chamber such that when the pressure in the intermediate chamber 452 is approximately equal to the pressure in the output chamber 456, liquid from the intermediate chamber 452 will flow through the control valves 474 and into the output chamber 456. A gas vent line 508 that is controlled by controlled gas valve 512 is utilized to vent gas from the intermediate chamber 452 to the input chamber (day tank) 420, and thereby control liquid flow from the input chamber (day tank) 420 through control valves 470 into the intermediate chamber 452. An air pressure equalization valve 520 is engaged with the input chamber (day tank) 420 to maintain atmospheric pressure within the day tank 420. A liquid recirculation/return line 530 is engaged to the liquid output line 480 to return and recirculate liquid from the output chamber 456, through a back pressure regulator valve 534 and into the input chamber (day tank) 420. To replace liquid that is pumped from the output chamber 456 through output valve 538 and utilized in a chemical process and not returned, a liquid source 540 is engaged through input lines 544 to the input chamber (day tank) 420.

Unlike pumps 10 and 202 described hereabove, the pump 400 does not use a float level or sensor to control its operation. Rather, pump 400 is controlled in a time sequence manner utilizing software and electronic control systems of the system controller 498 to open and close the gas valves. Specifically, where the various liquid flow rates and liquid pressures are known, it is relatively straightforward to calculate the time required to output a certain quantity of liquid from the output chamber at a specified flow rate based upon the gas pressure in the output chamber and other known parameters. Also with the known gas pressures that are utilized in the intermediate chamber, the time period for filling the output chamber from the intermediate chamber is also determinable, and the time that it takes to fill the intermediate chamber from the input chamber is likewise determinable. Therefore, having determined the time intervals required for filling the intermediate chamber and the output chamber, the gas pressurized pump 400 may be operated electronically in a timed valve control mode. That is, while the pump is constantly outputting liquid from the output chamber, the intermediate chamber can be filled from the input chamber at an appropriate time interval and the intermediate chamber can be emptied into the output chamber at an appropriate time interval, such that the operation of the pump is constant and ongoing.

Some control over the liquid level in the output chamber 456 may be necessary to a successful ongoing operation of the pump embodiment 400. Particularly, the liquid level in the output chamber 456 cannot be permitted to become so low that pressurized gas in the output chamber passes into the liquid outlet line 480. Likewise, if the liquid level in the output chamber 456 rises above the gas inlet valve 496, corrosion of the valve may occur. To prevent these problems, a low liquid level sensor 550 may be installed in association with the output chamber 456. The low liquid level sensor 550 is electronically engaged by line 554 to the system controller 498 to provide liquid level information to the system controller. Should the liquid level in the output tank 456 become too low, the system controller 498 electronically increases the time period that the control valves 474 and 470 are opened during each cycle, such that the quantity of liquid flowing into the output chamber 456 increases during each cycle. As a result, the liquid level in output chamber 456 will rise. Likewise, where the low liquid level sensor 550 provides signals to the system controller 498 that the liquid level in the output chamber 456 has become too high, the system controller 498 will reduce the time period that valves 470 and 474 are open during each cycle, thereby reducing the quantity of liquid that flows into the output chamber during each cycle. As a result, the liquid level within the output chamber 456 will be lowered.

Figure 5:
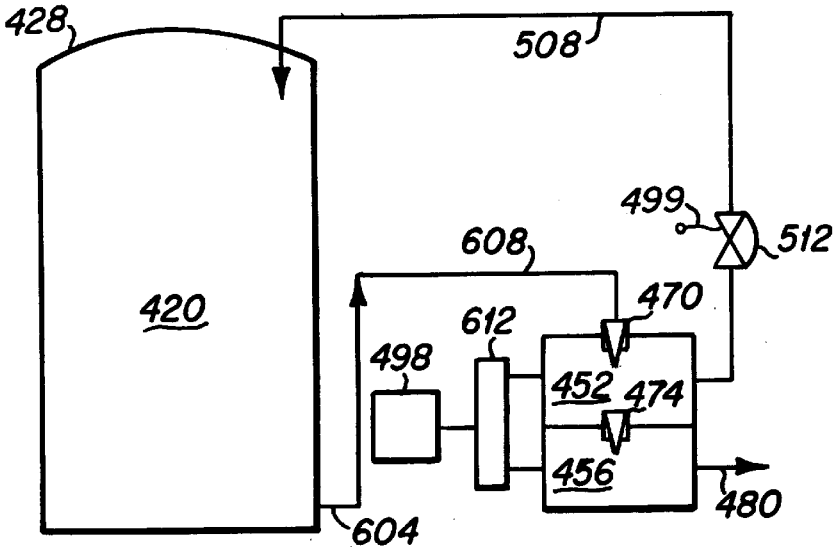
FIG. 5 is a diagrammatic depiction of a further embodiment of the present invention as used with a day tank.

While the day tank pump system 400 has been shown and described in a configuration in which the intermediate chamber 452 and output chamber 456 are disposed beneath the day tank 420, it is to be understood that the system 400 can likewise be constructed as a pump 600 in a segmented manner, as depicted in FIG. 5. As depicted therein, identical features to the pump system 400 are given identical numbers The day tank 420 comprises the input chamber of the pump 600, and the outlet 604 from the day tank 420 is plumbed into the separate intermediate chamber 452 through liquid line 608. A computer controlled valve 470 controls the flow of liquid from the input chamber (day tank 420) into the intermediate chamber 452, and control valve 474 controls the flow of liquid from the intermediate chamber into the output chamber 456. The computerized control system 498 and gas valve system 612 for the system 600 may be identical to the computerized control system for the tank pump embodiment 400. The pump embodiment 600 facilitates the utilization of the multiple chamber liquid pumping system of the prevent invention with previously installed day tanks.

While the present invention has been described with regard to certain preferred embodiments, it is intended by the inventor that the following claims cover all and various alterations and modifications therein that nevertheless include the true spirit and scope of the invention.

What I claim is:

1. A multi-chamber liquid pump comprising:

an input chamber having a means for inputting liquid thereinto;

an intermediate chamber;

a liquid output chamber having a means for outputting liquid therefrom;

a first liquid flow control valve being engaged between said input chamber and said intermediate chamber;

a second liquid flow control valve being engaged between said intermediate chamber and said output chamber;

a pressurized gas source being engaged to said output chamber to provide pressurized gas into said output chamber to output liquid from said output chamber;

said pressurized gas source being engaged to said intermediate chamber to provide pressurized gas to said intermediate chamber; and a pump controller being operable to control the flow of pressurized gas into and out of said intermediate chamber to control the flow of liquid from said input chamber into said intermediate chamber and from said intermediate chamber into said output chamber.

2. A pump as described in claim 1 wherein said pump controller includes a first controllable gas valve that controls the flow of gas into said intermediate chamber and a second controllable gas valve that controls the flow of gas from said intermediate chamber.

3. A pump as described in claim 2 wherein said pump controller includes a liquid level sensing device disposed within said output chamber that controls said first and second controllable gas valves.

4. A pump as described in claim 3 wherein said liquid level sensing device provides electronic control signals to said pump controller, and said pump controller provides electronic signals to control the operation of said first and second controlled gas valves.

5. A pump as described in claim 3 wherein said liquid level sensing device controls the flow of gas through a gas control line to control the operation of said first and second controlled gas valves.

6. A pump as described in claim 2 wherein said first and second controlled gas valves are controlled in a timer mode by said pump controller.

7. A pump as described in claim 1 wherein liquid that is output from said output chamber is thereafter input into said input chamber to recirculate said liquid through said pump.

8. A method for pumping liquid comprising the steps of:

inputting liquid into an input chamber of a multiple chamber pump;

controlling the gas pressure within an intermediate chamber of said pump to cause liquid within said input chamber to flow into said intermediate chamber;

controlling the gas pressure within said intermediate chamber to cause liquid to flow from said intermediate chamber into an output chamber of said pump;

controlling the gas pressure within said output chamber of said pump to cause liquid to constantly flow out of said output chamber.

9. A method as described in claim 8 wherein said steps of controlling the gas pressure within said intermediate chamber includes the step of determining the liquid level within said output chamber.

10. A method as described in claim 9 wherein said step of determining the liquid level within said output chamber includes the use of a float sensor.

11. A method as described in claim 9 wherein said step of controlling the gas pressure within said intermediate chamber includes the step of increasing the gas pressure within said intermediate chamber when said liquid level within said output chamber is low.

12. A method as described in claim 11 wherein said step of increasing said gas pressure within said intermediate chamber causes liquid within said intermediate chamber to flow into said output chamber.

13. A method as described in claim 9 wherein said step of controlling the gas pressure within said intermediate chamber includes the step of decreasing the gas pressure within said intermediate chamber when said liquid level within said output chamber is high.

14. A method as described in claim 13 wherein said step of decreasing said gas pressure within said intermediate chamber causes liquid within said input chamber to flow into said intermediate chamber.

15. A method as described in claim 8 wherein said step of controlling the gas pressure within said intermediate chamber includes the steps of altering said gas pressure within said intermediate chamber at predetermined time intervals.

16. A method as described in claim 15 wherein said step of altering said gas pressure includes the steps of increasing said gas pressure within said intermediate chamber to cause liquid to flow from said intermediate chamber into said output chamber.

17. A method as described in claim 15 wherein said step of altering said gas pressure includes the step of decreasing the gas pressure within said intermediate chamber to cause liquid within said input chamber to flow into said intermediate chamber.

* * * * *